US007518560B2

(12) United States Patent
Hung et al.

(10) Patent No.: US 7,518,560 B2
(45) Date of Patent: Apr. 14, 2009

(54) ANTENNA AND METHOD FOR EASILY TUNING THE RESONANT FREQUENCY OF THE SAME

(75) Inventors: Chen-Ta Hung, Tu-Chen (TW); Hsin Kuo Dai, Tu-chen (TW); Li-Heng Chen, Tu-chen (TW); Hsiang-Hui Shen, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/102,151

(22) Filed: Apr. 7, 2005

(65) Prior Publication Data

US 2006/0001590 A1 Jan. 5, 2006

(30) Foreign Application Priority Data

Jun. 30, 2004 (TW) ..... 93119326 A

(51) Int. Cl.
*H01Q 1/24* (2006.01)

(52) U.S. Cl. ..... 343/702

(58) Field of Classification Search ..... 343/700 MS, 343/702, 785, 772; 333/237, 238, 239
See application file for complete search history.

(56) References Cited

U.S. PATENT DOCUMENTS

| | | | | |
|---|---|---|---|---|
| 5,448,252 | A * | 9/1995 | Ali et al. | 343/700 MS |
| 6,023,244 | A * | 2/2000 | Snygg et al. | 343/700 MS |
| 6,380,905 | B1 | 4/2002 | Annamaa et al. | |
| 6,509,873 | B1 * | 1/2003 | Nalbandian et al. | 343/700 MS |
| 6,734,826 | B1 * | 5/2004 | Dai et al. | 343/700 MS |
| 6,839,030 | B2 * | 1/2005 | Noujeim | 343/700 MS |
| 6,850,197 | B2 * | 2/2005 | Paun | 343/702 |

* cited by examiner

*Primary Examiner*—Huedung Mancuso
(74) *Attorney, Agent, or Firm*—Wei Te Chung

(57) ABSTRACT

A method for tuning a resonant frequency of an antenna includes the steps of providing an antenna having a radiating element operating at a present resonant frequency, determining a target operating frequency of the antenna, mensurating the present resonant frequency of the antenna and calculating a frequency offset between the present resonant frequency and the target operating frequency, providing a dielectric film covered on the radiating element, tuning an thickness and an area of the dielectric film, and repeating the mensurating step and the tuning step till the frequency offset reaches zero.

20 Claims, 7 Drawing Sheets

ANTENNA AND METHOD FOR EASILY TUNING THE RESONANT FREQUENCY OF THE SAME

BACKGROUND OF THE INVENTION

1. Field of the Invention

The present invention relates generally to an antenna, and more particularly to a tuning method of an antenna.

2. Description of the Prior Art

An antenna is a passive element used in a wireless communication device for transmitting and receiving electromagnetic signals. Compared with other passive elements, designing and developing an antenna is more complex because the antenna has a large number of target parameters should be taken into account during design and development, such as the dimensions, the resonant frequency, the bandwidth, the impedance matching and the gain, and so on. So far as mobile communication system and wireless local area network (WLAN) are concerned, though design of general compact-size antennas comes to mature, such as a planar inverted-F antenna, a microstrip antenna, a slot antenna, a patch antenna, etc, a problem of practical parameters being not up to the target parameters is still troubling. In conventional design, take a familiar planar inverted-F antenna (PIFA) for example, engineers usually calculate the theoretical dimensions of the PIFA at first, then make the antenna according to the theoretic dimensions, then tune the impedance matching by tuning the practical dimensions of the antenna, and finally tune the resonant frequency by tuning the practical dimensions of the antenna. When aiming at tuning the resonant frequency, a most common solution is to change the effective length of the radiating path which means the length between a feeder point of the antenna and an free end of a radiating element. For a PIFA, the radiating path should be a quarter of the operating wavelength of the antenna. The resonant frequency may be increasing by shortening the radiating path. Contrarily, the resonant frequency may be lowered down by lengthening the radiating path. Generally in making an antenna, the radiating path of the antenna is predetermined a little longer than the quarter of the operating wavelength at first, then gradually reduced to make a present resonant frequency gradually be close to the target resonant frequency with a best situation of the present resonant frequency equal to the target resonant frequency. However, once a tuning range of the length of the radiating path is excessive leading to the present resonant frequency overrunning the target resonant frequency, the above-mentioned solution will be invalid. In this case, a further remedial process is needed to tune a position of the feeder point more distant from the free end of the radiating element so as to increase the length of the radiating path. However, once the position of the feeder point is changed, the impedance will be mismatched which then needed to be tuned again and again. The whole tuning process is too time consuming.

Hence, in this art, an antenna with easily tuned resonant frequency and a method for easily tuning the resonant frequency of the antenna to overcome the above-mentioned disadvantages of the prior arts will be described in detail in the following embodiments.

BRIEF SUMMARY OF THE INVENTION

A primary object, therefore, of the present invention is to provide an antenna having a dielectric film covering thereon for tuning a resonant frequency thereof.

Another object, therefore, of the present invention is to provide a method for easily tuning the resonant frequency of the antenna.

In order to implement the above object and overcome the above-identified deficiencies in the prior art, the antenna comprises a grounding portion arranged in a lengthwise direction, a connecting portion extending from the grounding portion, a radiating portion substantially parallel to the grounding portion and connecting with an end of the connecting portion, and comprising a first and a second radiating elements extending in opposite directions along said lengthwise direction, and a dielectric film covering on the radiating portion. The method for tuning a resonant frequency of the antenna comprises providing an antenna having a radiating element operating at a present resonant frequency, determining a target operating frequency of the antenna, mensurating the present resonant frequency of the antenna and calculating a frequency offset between the present resonant frequency and the target operating frequency, providing a dielectric film covered on the radiating element, tuning an thickness and an area of the dielectric film, and repeating the mensurating step and the tuning step till the frequency offset reaches zero.

Other objects, advantages and novel features of the invention will become more apparent from the following detailed description of preferred embodiments when taken in conjunction with the accompanying drawings.

DETAILED DESCRIPTION OF THE INVENTION

The present invention is suitable to all kinds of antennas, such as an inverted-F antenna, a dipole antenna, a slot antenna, a microstrip antenna, and so on. The present invention is also suitable to antennas having different making forms, such as a printed antenna, a patch antenna, a metal sheet antenna, and so on. Reference will now be made in detail to preferred embodiments of the present invention.

Figure 1:
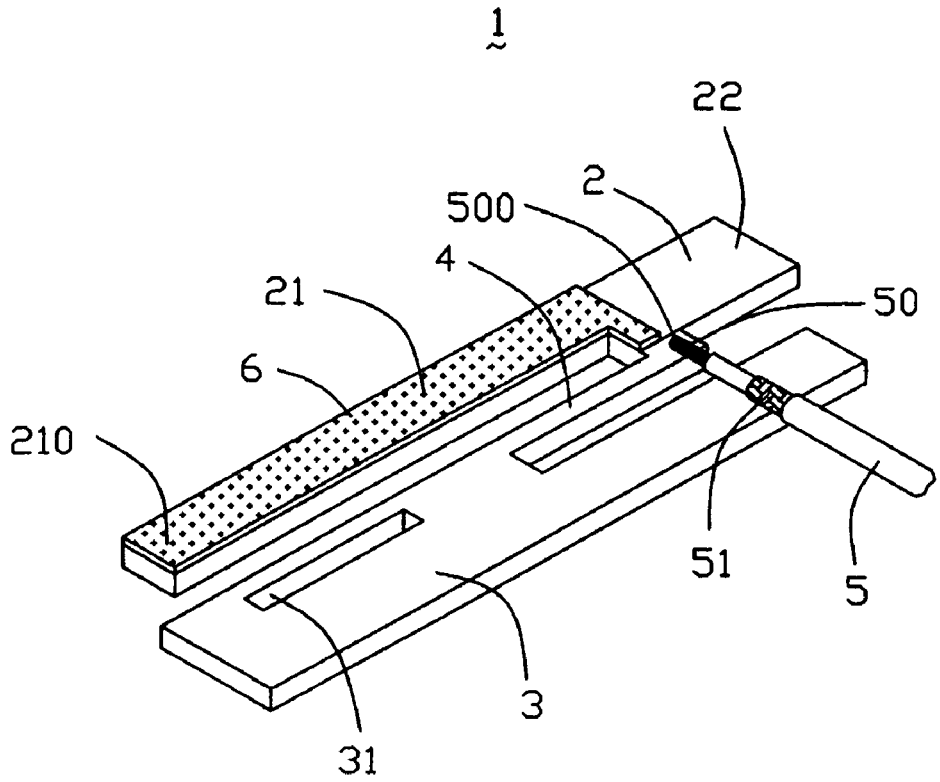
FIG. 1 is a perspective view of an antenna in accordance with a first embodiment of the present invention.

Referring to FIG. 1, a multi-band planar inverted-F antenna 1 according to a first embodiment of the present invention comprises a radiating portion 2, a grounding portion 3, a connecting portion 4 connecting the radiating portion 2 and the grounding portion 3, and a feeder cable 5. The radiating portion 2, the grounding portion 3 and the connecting portion 4 are integrally made of a metal sheet and arranged in a same plane.

The grounding portion 3 is placed in a lengthwise direction and defines a slot 31. The connecting portion 4 is formed in configuration of an elongate bar extending from the grounding portion 3. The slot 31 and the connecting portion 4 are both used for tuning an impedance matching of the antenna 1. The feeder cable 5 is a coaxial cable and comprises an inner conductor 50 soldered on an end of the connecting portion 4 and an outer conductor 51 soldered on the grounding portion 3. A feeder point 500 is arranged at a conjunction of the feeder cable 5 and the radiating portion 2. The radiating portion 2 is substantially rectangular shaped and comprises a first radiating element 21 and a second radiating element 22 extending from the feeder point 500 in opposite directions along said lengthwise direction. The second radiating element 22 is wider and shorter than the first radiating element 21. The first radiating element 21 is resonant at a lower frequency band such as 2.4-2.5 GHz with a central frequency at 2.45 GHz. The second radiating element 22 is resonant at a higher frequency band such as 5.15-5.875 GHz with a central frequency at 5.5 GHz. The radiating elements 21, 22 each have a main portion 210, 220 respectively adjacent to a first free end of the first radiating element 21 and a second free end of the second radiating element 22 at which the electromagnetic wave is strongest when the antenna resonates.

Figure 6:
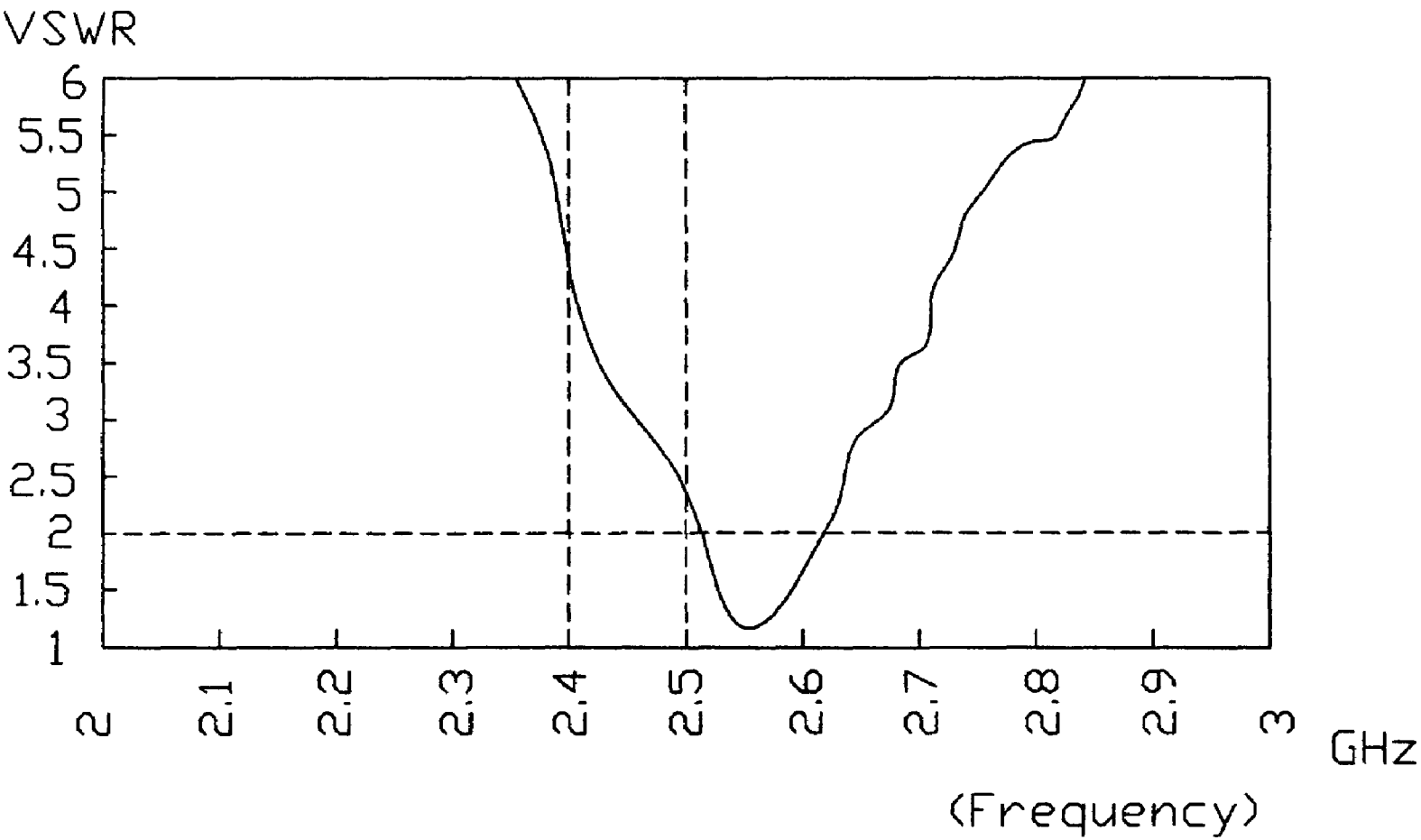
FIG. 6 is a test chart recording of Voltage Standing Wave Ratio (VSWR) of the antenna of FIG. 1 without a dielectric film as a function of frequency.

In order to illustrate the effectiveness of the present invention, a comparison experiment used the aforementioned antenna 1 is put into practice. Referring to FIG. 6, a test chart recording of Voltage Standing Wave Ratio (VSWR) of the present antenna 1 as a function of frequency shows that the VSWR drops below the desirable maximum value "2" in the 2.5-2.6 GHz frequency band with a present central frequency of 2.55 GHz which is far away from the target central frequency of 2.4 GHz in ISM band.

Referring again to FIG. 1, to reduce the present central frequency to the target central frequency, a dielectric film 6 is used to cover a main surface of first radiating element 21. The dielectric film 6 can be chosen many kinds of dielectric material, for example, capton. After covering the dielectric film 6, a dielectric constant around the first radiating element 21 is increased, therefore a reflex wave transmitted between the first free end of the first radiating element 21 and the grounding portion 3 occurs downward frequency shift, due to which the standing wave (combination of incident wave and reflex wave) is led to a downward frequency offset. The frequency offset is in proportion to the thickness and the area of the dielectric film 6. The larger and more thickness the dielectric film 6 is, the larger the downward frequency offset is.

Figure 7:
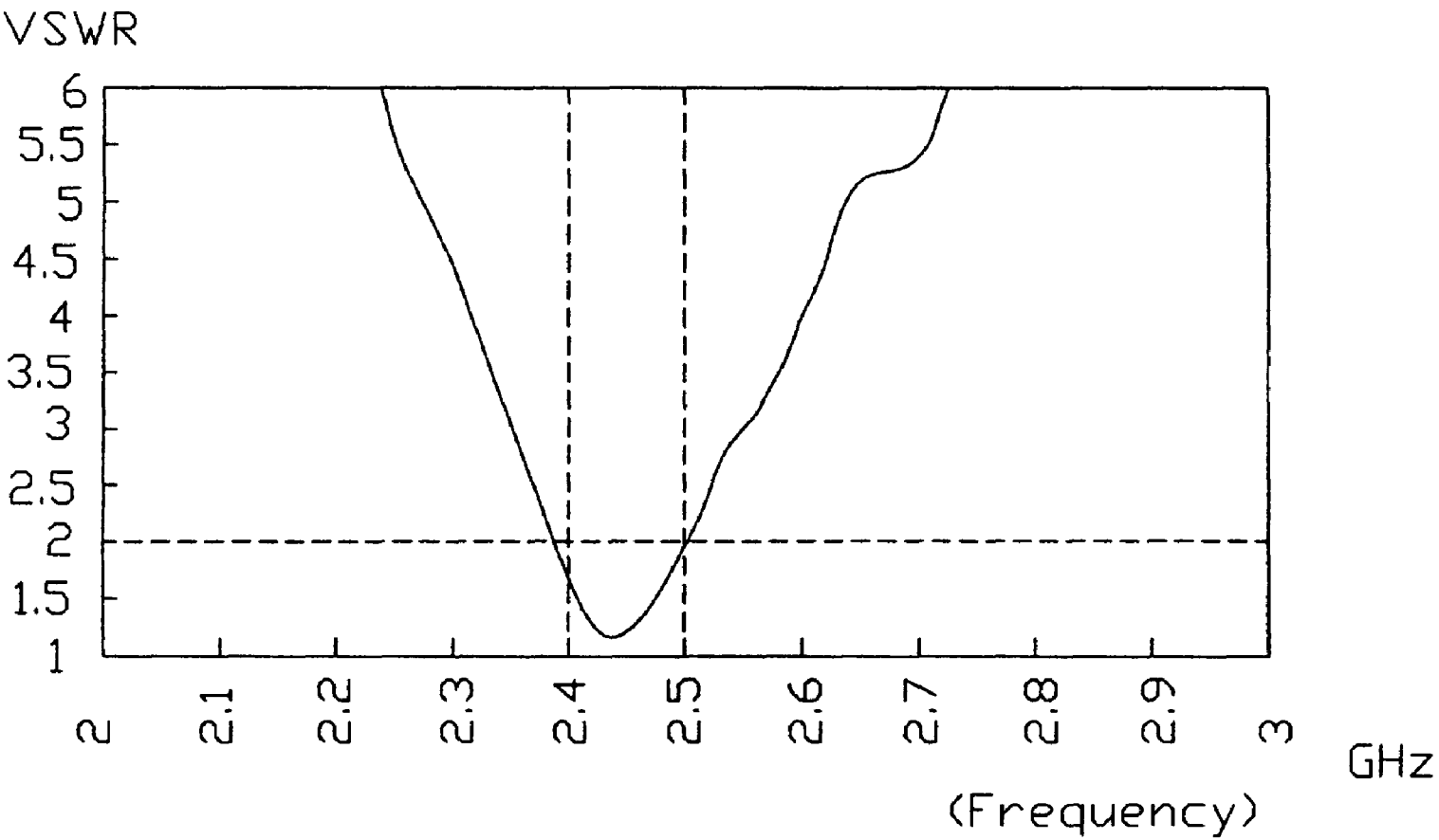
FIG. 7 is a test chart recording of Voltage Standing Wave Ratio (VSWR) of the antenna of FIG. 1 with a dielectric film covering thereon as a function of frequency.

Referring to FIG. 7, a test chart recording of VSWR of the antenna 1 with the dielectric film 6 covering thereon as a function of frequency is shown. Note that the VSWR drops below the desirable maximum value "2" in the 2.4-2.5 GHz frequency band, which is much lower than the resonant frequency band of the antenna 1 without the dielectric film 6. Compared with FIG. 6, the bandwidths of the antenna 1 with the dielectric film 6 and without the dielectric film 6 are nearly the same because the impedance matching remains unchanged.

Figure 2:
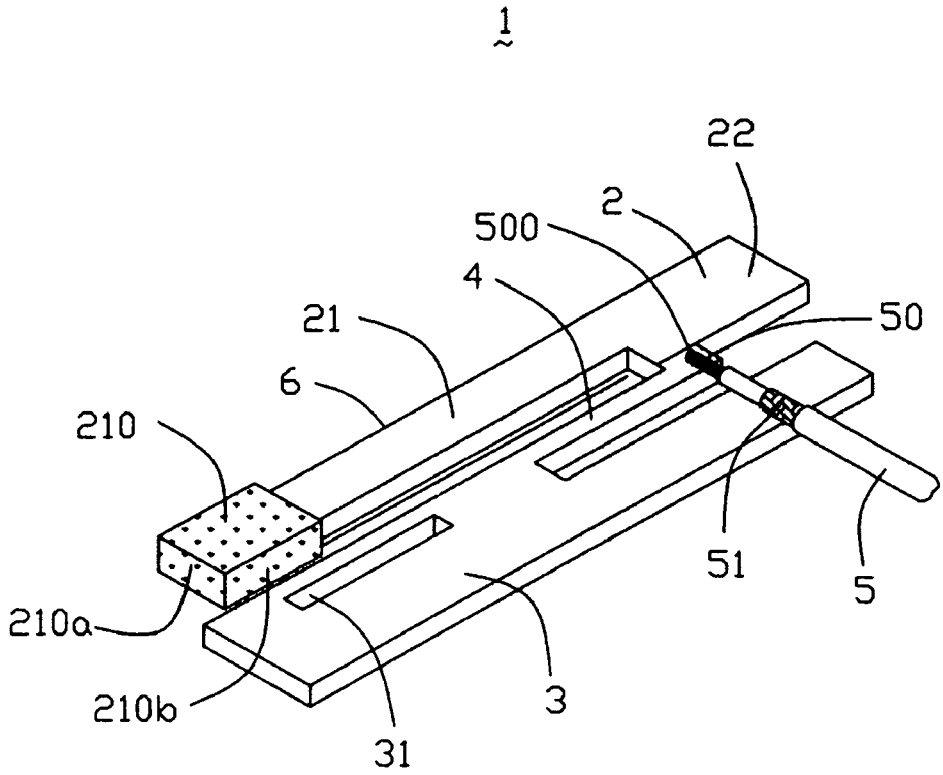
FIG. 2 is a perspective view of an antenna in accordance with a second embodiment of the present invention.

Referring to FIG. 2, an antenna according to a second embodiment of the present invention is substantially the same as the first embodiment except the dielectric film 6. The dielectric film 6 of the second embodiment is covered on overall exposed surfaces of the main portion 210 of the first radiating element 21 to reduce the present central frequency. The exposed surfaces comprises an upper surface which is substantially a part of the main surface, a lower surface (not shown), a front surface 210*a* opposite to the grounding portion 3, a rear surface (not shown) opposite to the front surface 210*a* and a side surface 210*b*.

Figure 3:
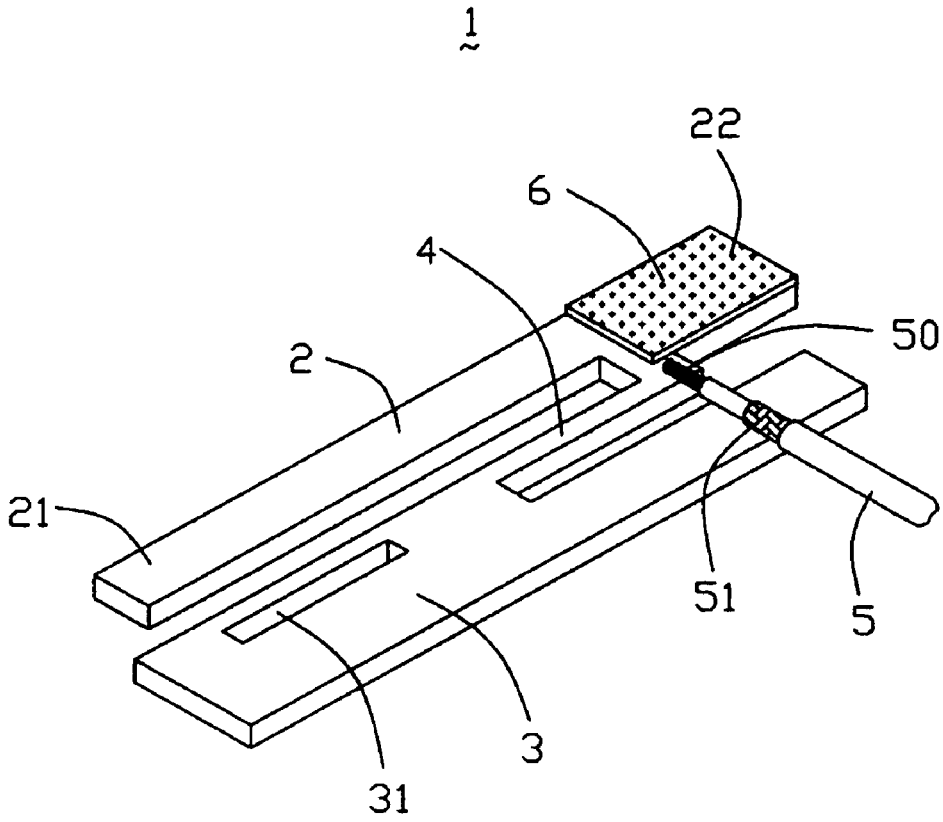
FIG. 3 is a perspective view of an antenna in accordance with a third embodiment of the present invention.

Referring to FIG. 3, an antenna according to a third embodiment of the present invention is substantially the same as the first embodiment except the dielectric film 6. When frequency shift happens on the second radiating element 22, the dielectric film 6 of the second embodiment is covered on the second radiating element 22 to reduce the resonant frequency of the second radiating element 22. Obviously, the dielectric film 6 can be covered fully or partially on the second radiating element 22 as long as one of the exposed surfaces of the main portion thereof is covered.

Figure 4:
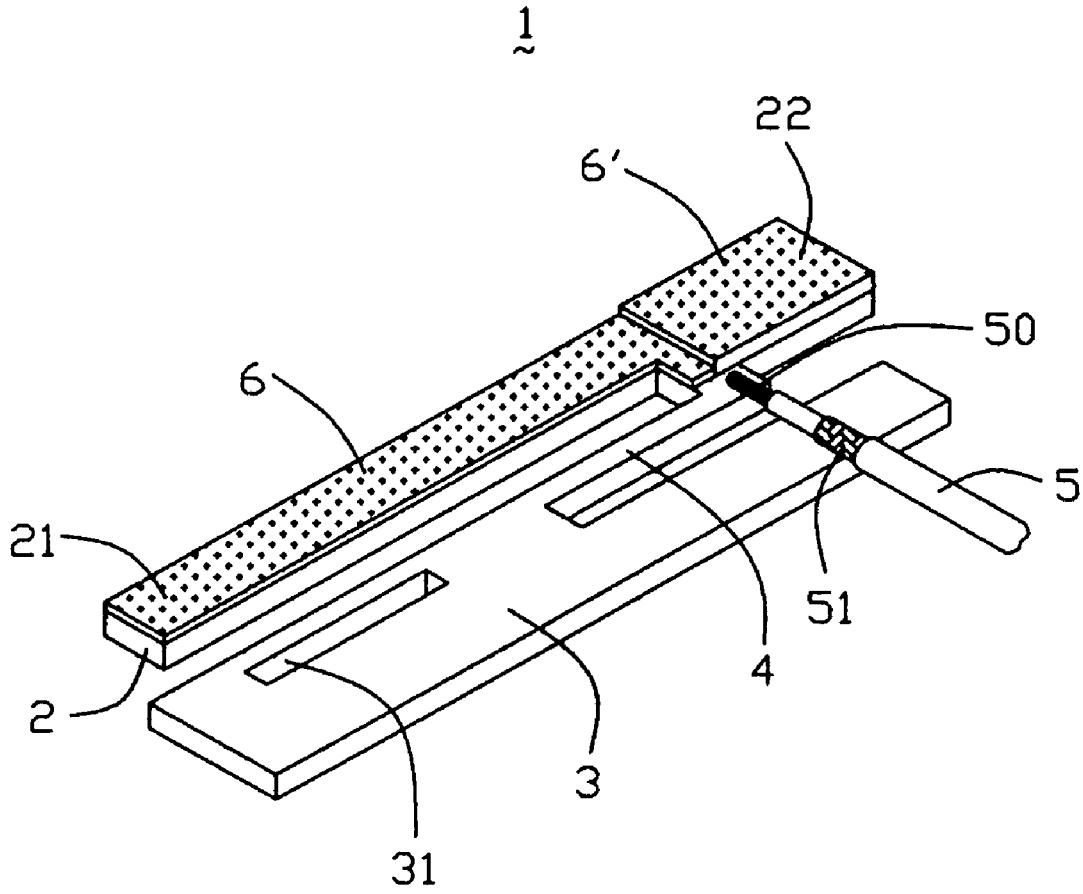
FIG. 4 is a perspective view of an antenna in accordance with a fourth embodiment of the present invention.

Referring to FIG. 4, for a multi-band antenna, frequency shift happens on both the first and the second radiating elements 21, 22 with different offsets. For example, the second radiating element 22 has a larger offset than the first radiating element 21. A first and a second dielectric films 6 and 6' of a fourth embodiment of the present invention are respectively used for fully or partially covering the first and the second radiating elements 21, 22. A thickness of the first dielectric film 6 is smaller than that of the second dielectric film 6'.

Figure 5:
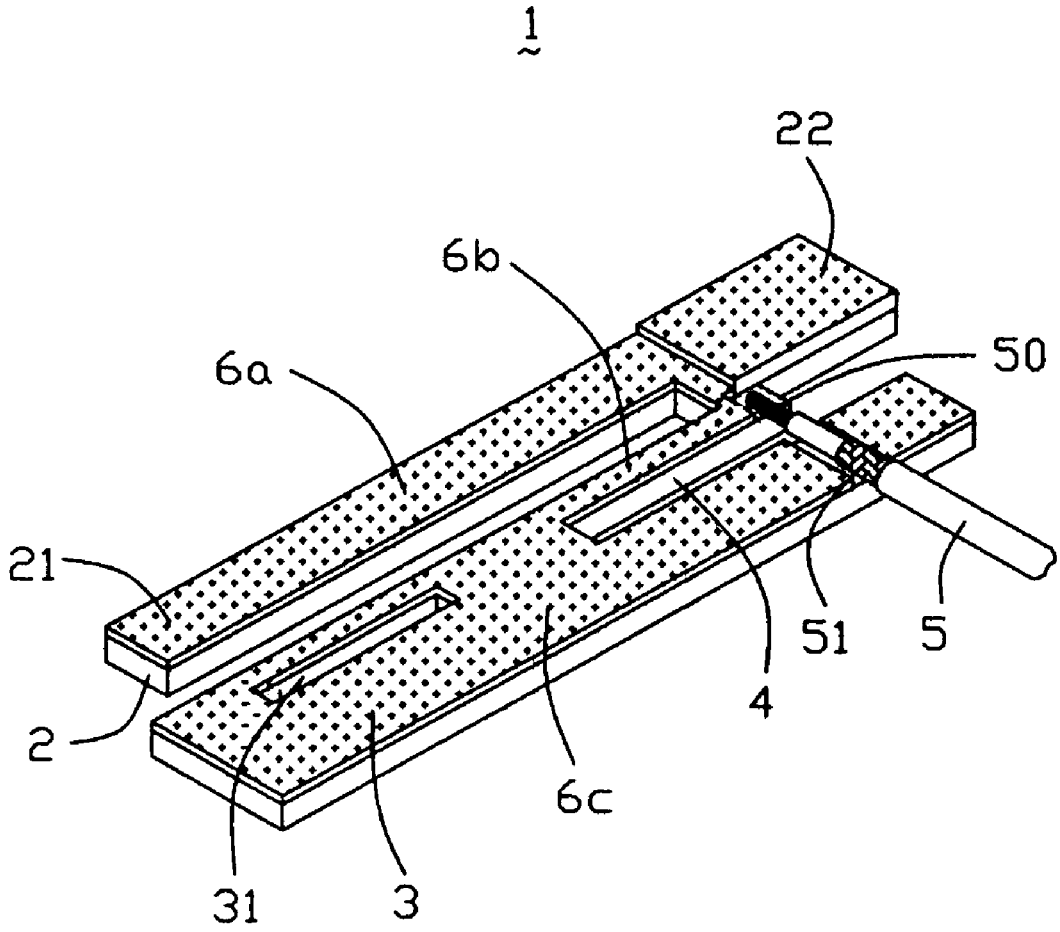
FIG. 5 is a perspective view of an antenna in accordance with a fifth embodiment of the present invention.

Referring to FIG. 5, dielectric films 6*a*, 6*b*, 6*c* of a fifth embodiment of the present invention are respectively covered on the radiating portion 2, the grounding portion 3 and the connecting portion 4. The dielectric film 6*a* has the same function of tuning resonant frequencies as described in the fourth embodiment. The dielectric films 6*b* and 6*c* are only provided for protect the antenna 1 from oxygenation by air or corrosion by unexpected substances.

In conjunction with the above description, a method for tuning the resonant frequency of the multi-band antenna in accordance with the present invention comprises the following steps. Firstly, determining a target central frequency of one of the radiating elements of the antenna which now acts as a mensuration radiating element. Secondly, mensurating a present resonant frequency of said mensuration radiating element and calculating a frequency offset between the present resonant frequency and the target central frequency, wherein the present resonant frequency is higher than the target central frequency. Thirdly, covering a dielectric film fully or partially on said mensuration radiating element according to said frequency offset and repeating the second step. Fourthly, if the present resonant frequency is higher than the target central frequency, increasing a thickness or area of the dielectric film; if the present resonant frequency is lower than the target central frequency, decreasing the thickness or area of the dielectric film. Fifthly, repeating the second and the fourth steps till the frequency offset reaches zero. Finally, tuning the frequencies of other radiating elements of the multi-band antenna following the above-mentioned steps of first to five.

It is to be understood, however, that even though numerous characteristics and advantages of the present invention have been set forth in the foregoing description, together with details of the structure and function of the invention, the disclosure is illustrative only, and changes may be made in detail within the principles of the invention to the full extent indicated by the broad general meaning of the terms in which the appended claims are expressed.

What is claimed is:

1. A PIFA antenna, comprising:

a grounding portion arranged in a lengthwise direction;

a connecting portion extending from the grounding portion; and a radiating portion substantially parallel to the grounding portion and connecting with an end of the connecting portion, the radiating portion comprising a main surface having a length and a width, the radiating portion comprising a first and a second radiating elements extending in opposite directions along said lengthwise direction; and a dielectric film on the main surface of the radiating portion to fully cover the radiating portion along said width direction to reduce a target center frequency of the antenna, wherein the radiating portion, the connecting portion and the grounding portion are integrally made of metal sheet and arranged in a same plane.

2. The antenna as claimed in claim 1, wherein the connecting portion extends from the grounding portion in said lengthwise direction and the grounding portion defines a slot therein, the connecting portion and the slot both used for tuning an impedance matching of the antenna.

3. The antenna as claimed in claim 1, wherein each radiating element have a main surface, the dielectric film completely covering on at least one of the main surfaces of the first and the second radiating elements.

4. The antenna as claimed in claim 1, wherein the first and the second radiating elements each comprise a main portion adjacent to a free end thereof at which the electromagnetic wave is strongest when the antenna resonates, the dielectric film covering overall exposed surfaces of the main portion.

5. The antenna as claimed in claim 1, wherein the dielectric film is covered on both the first and the second radiating elements, an thickness of the dielectric film covering on the first radiating element different from that on the second radiating element.

6. The antenna as claimed in claim 5, wherein the dielectric film is covered on the radiating portion, the connecting portion and the grounding portion.

7. An antenna comprising:

a grounding portion;

a radiating portion spaced from the grounding portion;

a connecting portion connected between the grounding portion and the radiating portion and dividing said radiating portion into two opposite differently dimensioned or configured radiating elements by two sides of said connecting portion asymmetrically for resonating at two different frequency bands, respectively;

a feeder cable including an inner conductor connected to the connecting portion and an outer conductor connected to the grounding portion; and a dielectric film located on at least one of the radiating portion and the grounding portion, under a condition of being dimensioned and configured to tune a desired resonant target center frequency of at least one of said two different frequency bands.

8. The antenna as claimed in claim 7, wherein said grounding portion and said radiating portion are parallel to each other.

9. The antenna as claimed in claim 7, wherein said grounding portion and said radiating portion are essentially coplanar with each other.

10. The antenna as claimed in claim 7, wherein said connecting portion is of an L-shaped configuration.

11. The antenna as claimed in claim 10, wherein a short section of said L-shaped configuration is connected to the radiating portion and a long section of said L-shaped configuration is connected to the grounding portion.

12. The antenna as claimed in claim 7, wherein said connecting portion is of an L-shaped configuration.

13. The antenna as claimed in claim 7, wherein only one of the at least a dielectric film is asymmetrically located on the radiating portion.

14. The antenna as claimed in claim 7, wherein there are two of said at least dielectric film having different thicknesses with each other.

15. The antenna as claimed in claim 14, wherein said two dielectric films are asymmetrically located on the radiating portion.

16. The antenna as claimed in claim 14, wherein said two dielectric films are laterally continuously linked to each other.

17. The antenna as claimed in claim 7, wherein there are two of said at least dielectric film having different configurations with each other.

18. The antenna as claimed in claim 17, wherein said two dielectric films are asymmetrically located on the radiating portion.

19. The antenna as claimed in claim 7, wherein said at least one dielectric film covers both the radiation portion and the grounding portion at least partially.

20. The antenna as claimed in claim 7, wherein configuration or dimension of said dielectric film is decided by a thickness or an area thereof.

* * * * *